US008484790B2

(12) United States Patent
Knafl et al.

(10) Patent No.: US 8,484,790 B2
(45) Date of Patent: Jul. 16, 2013

(54) EXHAUST GAS RECIRCULATION COOLER CLEANER HAVING ACTIVE MATERIAL ACTUATOR

(75) Inventors: Alexander Knafl, Royal Oak, MI (US); Patrick G. Szymkowicz, Shelby Township, MI (US); Alan L. Browne, Grosse Pointe, MI (US); Nancy L. Johnson, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 946 days.

(21) Appl. No.: 12/511,767

(22) Filed: Jul. 29, 2009

(65) Prior Publication Data

US 2010/0186783 A1 Jul. 29, 2010

Related U.S. Application Data

(60) Provisional application No. 61/084,817, filed on Jul. 30, 2008.

(51) Int. Cl.
*B08B 9/043* (2006.01)

(52) U.S. Cl.
USPC ..... 15/104.05; 134/6; 15/104.16

(58) Field of Classification Search
USPC ..... 15/104.05, 104.16–104.2; 134/6
See application file for complete search history.

(56) References Cited

U.S. PATENT DOCUMENTS

| | | | | |
|---|---|---|---|---|
| 3,460,180 | A * | 8/1969 | Girard | 15/104.061 |
| 4,244,072 | A * | 1/1981 | Dunham et al. | 15/104.095 |
| 4,562,886 | A * | 1/1986 | Holm | 165/94 |
| 4,676,301 | A * | 6/1987 | Sakamoto | 165/95 |

FOREIGN PATENT DOCUMENTS

WO WO 2005/049240 A1 * 6/2005

* cited by examiner

*Primary Examiner* — Laura C Guidotti

(57) ABSTRACT

A cleaning mechanism for and method of autonomously removing deposits from the interior surface of a tube comprises a cleaning member secured relative to the surface and preferably, an active material element drivenly coupled to or engaged with the member so as to selectively cause the member to translate, thereby removing deposits from the surface.

16 Claims, 2 Drawing Sheets

EXHAUST GAS RECIRCULATION COOLER CLEANER HAVING ACTIVE MATERIAL ACTUATOR

RELATED APPLICATIONS

This patent application claims priority to and benefit from U.S. Provisional Patent Application Ser. No. 61/084,817, entitled "EXHAUST GAS RECIRCULATION COOLER CLEANER HAVING ACTIVE MATERIAL ACTUATOR," and filed on Jul. 30, 2008, the disclosure of which is incorporated by reference herein.

BACKGROUND OF THE INVENTION

1. Field of the Invention

The present disclosure generally relates to mechanisms adapted for cleaning the interior surface of a tube, and in particular, to a mechanism for, and method of cleaning a tube, such as an Exhaust Gas Recirculation (EGR) cooling tube, that utilizes active material actuation.

2. Discussion of Prior Art

Conveyance tubes, particularly those used in EGR systems, can accumulate unwanted deposits on their interior surfaces. These deposits can negatively impact the performance of the system; for example, by reducing thermal efficiency and increasing flow restriction. Currently, removing these deposits requires deconstruction of the EGR system and applying a manual cleaning tool to remove the deposits. This presents various concerns in the art, including, for example, the need to incur down-time in having to send the system to a shop and the expenditure of significant man-hours by a trained specialist to perform the cleaning. Accordingly, there is a need in the art for a tube cleaning mechanism that autonomously dislodges deposits without requiring significant man-hours or the disassembly of the system.

BRIEF SUMMARY OF THE INVENTION

Responsive to the concerns of the prior art, the present invention recites a mechanism adapted for and method of removing deposits from the interior surface of a tube that preferably utilizes active material actuation. The invention is useful, among other things, for allowing the removal of deposits in situ, without disassembling the system. As such, the invention is further useful for increasing efficiency and otherwise improving system performance. In an EGR application, for example, removal of internal deposits enables greater in-cylinder NOX control and engine durability.

In general, the system includes a cleaning member that contacts the surface of the tube or is in sufficient proximity to contact deposits thereupon. The mechanism further includes an active material element which undergoes a reversible transformation in fundamental property when exposed to or occluded from an activation signal, and is drivenly coupled to the member. The member and element are cooperatively configured to dislodge deposits, when the element is activated. Preferred embodiments include those wherein the cleaning member presents a spring or scraping tool. The invention may also include a lever or pulleys to allow for different packing arrangements, and a return mechanism, such as a mechanical spring to oppose displacement caused by the active material element.

The disclosure may be understood more readily by reference to the following detailed description of the various features of the disclosure and the examples included therein.

BRIEF DESCRIPTION OF THE SEVERAL VIEWS OF THE DRAWING

A preferred embodiment(s) of the invention is described in detail below with reference to the attached drawing figures of exemplary scale, wherein.

BRIEF DESCRIPTION OF THE INVENTION

Figure 1A:
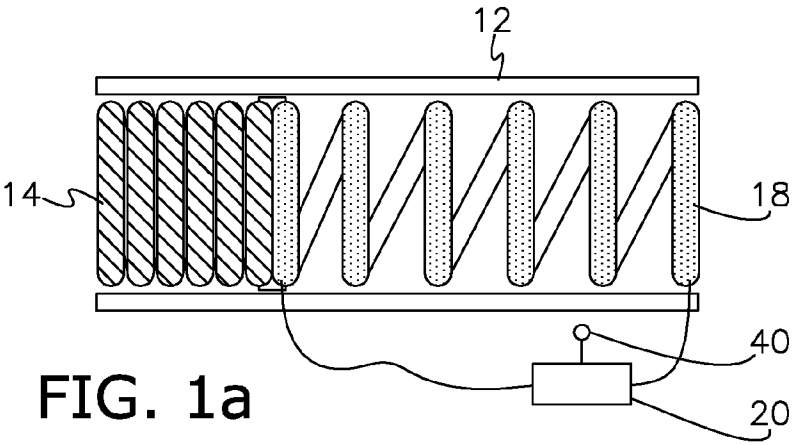
FIG. 1*a* is an elevation of the mechanism shown in FIG. 1, further showing a signal source and sensor communicatively coupled to the active material spring, and particularly illustrating the springs in cross-section, in accordance with a preferred embodiment of the invention.

The present invention concerns a cleaning mechanism 10 adapted for use with and methods of autonomously cleaning a conveyance tube 12. The mechanism 10 includes and the methods utilize an internal cleaning member (or "insert") 14 operable to selectively engage the interior surface 12*a* defined by the tube 12. More particularly, the member 14 directly engages or is disposed proximate to the surface 12*a*, so as to be operable to cause deposits 16 formed thereupon to become dislodged. The invention is particularly suitable for use with Exhaust Gas Recirculation (EGR) tubes; however, it is appreciated that the invention may be used in other applications, and that, as such, the mechanism 10 is not limited to the uses described and illustrated herein.

In the preferred embodiments of the invention, the mechanism 10 includes an active material element 18 generally operable to displace the cleaning member 14 when exposed to an activation signal; however, it is certainly within the ambit of the invention to utilize other non-active material based actuators, such as electric motors, solenoids, vacuum actuators, etc. to supplant the active material element 18 and drive the cleaning mechanism 10.

I. Active Material Description and Functionality

The term "active material" shall be afforded its ordinary meaning as understood by those of ordinary skill in the art, and includes any material or composite that exhibits a reversible change in a fundamental (e.g., chemical or intrinsic physical) property, when exposed to an external signal source 20. Suitable active materials for use with the present invention include but are not limited to shape memory alloys, electroactive polymers (EAP), ferromagnetic shape memory alloys (FSMA), magnetorheological (magnetic reactive) polymers, unimorphic or bimorphic piezoceramics, and other equivalent active materials that can cause a displacement upon activation Depending on the particular active material, the activation signal can take the form of, without limitation, an electric current, an electric field (voltage), a temperature change, and the like.

More particularly, shape memory alloys (SMA's) generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain. Generally, in the low temperature, or Martensite phase, shape memory alloys can be pseudo-plastically deformed and upon exposure to some higher temperature will transform to an Austenite phase, or parent phase, returning to their shape prior to the deformation.

Shape memory alloys exist in several different temperature-dependent phases. The most commonly utilized of these phases are the so-called Martensite and Austenite phases discussed above. In the following discussion, the Martensite phase generally refers to the more deformable, lower temperature phase whereas the Austenite phase generally refers to the more rigid, higher temperature phase. When the shape memory alloy is in the Martensite phase and is heated, it begins to change into the Austenite phase. The temperature at which this phenomenon starts is often referred to as Austenite start temperature ($A_s$). The temperature at which this phenomenon is complete is called the Austenite finish temperature ($A_f$).

When the shape memory alloy is in the Austenite phase and is cooled, it begins to change into the Martensite phase, and the temperature at which this phenomenon starts is referred to as the Martensite start temperature ($M_s$). The temperature at which Austenite finishes transforming to Martensite is called the Martensite finish temperature ($M_f$). Generally, the shape memory alloys are softer and more easily deformable in their Martensitic phase and are harder, stiffer, and/or more rigid in the Austenitic phase. In view of the foregoing, a suitable activation signal for use with shape memory alloys is a thermal activation signal having a magnitude to cause transformations between the Martensite and Austenite phases.

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the Martensite to Austenite type transition, and the material will recover the original, annealed shape. Hence, one-way shape memory effects are only observed upon heating. Active materials comprising shape memory alloy compositions that exhibit one-way memory effects do not automatically reform, and will likely require an external mechanical force to reform the shape.

Intrinsic and extrinsic two-way shape memory materials are characterized by a shape transition both upon heating from the Martensite phase to the Austenite phase, as well as an additional shape transition upon cooling from the Austenite phase back to the Martensite phase. Intrinsic two-way shape memory behavior must be induced in the shape memory material through processing. Such procedures include extreme deformation of the material while in the Martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, active materials that exhibit the extrinsic two-way shape memory effects are composite or multi-component materials that combine a shape memory alloy composition that exhibits a one-way effect with another element that provides a restoring force to reform the original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system 10 with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

It is appreciated that SMA's exhibit a modulus increase of 2.5 times and a dimensional change (recovery of pseudo-plastic deformation induced when in the Martensitic phase) of up to 8% (depending on the amount of pre-strain) when heated above their Martensite to Austenite phase transition temperature. It is appreciated that thermally induced SMA phase changes are one-way so that a biasing force return mechanism (such as a spring) would be required to return the SMA to its starting configuration once the applied field is removed. Joule heating can be used to make the entire system electronically controllable.

Ferromagnetic Shape Memory Alloys (FSMA) are a subclass of SMA. FSMA can behave like conventional SMA materials that have a stress or thermally induced phase transformation between martensite and austenite. Additionally FSMA are ferromagnetic and have strong magneto-crystalline anisotropy, which permit an external magnetic field to influence the orientation/fraction of field aligned martensitic variants. When the magnetic field is removed, the material may exhibit complete two-way, partial two-way or one-way shape memory. For partial or one-way shape memory, an external stimulus, temperature, magnetic field or stress may permit the material to return to its starting state. Perfect two-way shape memory may be used for proportional control with continuous power supplied. One-way shape memory is most useful for latching-type applications where a delayed return stimulus permits a latching function. External magnetic fields are generally produced via soft-magnetic core electromagnets in automotive applications. Electric current running through the coil induces a magnetic field through the FSMA material, causing a change in shape. Alternatively, a pair of Helmholtz coils may also be used for fast response.

Exemplary ferromagnetic shape memory alloys are nickel-manganese-gallium based alloys, iron-platinum based alloys, iron-palladium based alloys, cobalt-nickel-aluminum based alloys, and cobalt-nickel-gallium based alloys Like SMA these alloys can be binary, ternary, or any higher order so long as the alloy composition exhibits a shape memory effect, e.g., change in shape, orientation, yield strength, flexural modulus, damping capacity, superelasticity, and/or similar properties. Selection of a suitable FSMA composition depends, in part, on the temperature range and the type of response in the intended application.

Suitable piezoelectric materials include, but are not intended to be limited to, inorganic compounds, organic compounds, and metals. With regard to organic materials, all of the polymeric materials with non-centrosymmetric structure and large dipole moment group(s) on the main chain or on the side-chain, or on both chains within the molecules, can be used as suitable candidates for the piezoelectric film. Exemplary polymers include, for example, but are not limited to, poly(sodium 4-styrenesulfonate), poly (poly(vinylamine) backbone azo chromophore), and their derivatives; polyfluorocarbons, including polyvinylidenefluoride, its co-polymer vinylidene fluoride ("VDF"), co-trifluoroethylene, and their derivatives; polychlorocarbons, including poly(vinyl chloride), polyvinylidene chloride, and their derivatives; polyacrylonitriles, and their derivatives; polycarboxylic acids, including poly(methacrylic acid), and their derivatives; polyureas, and their derivatives; polyurethanes, and their derivatives; bio-molecules such as poly-L-lactic acids and their derivatives, and cell membrane proteins, as well as phosphate bio-molecules such as phosphodilipids; polyanilines and their derivatives, and all of the derivatives of tetramines; polyamides including aromatic polyamides and polyimides, including Kapton and polyetherimide, and their derivatives; all of the membrane polymers; poly(N-vinyl pyrrolidone) (PVP) homopolymer, and its derivatives, and random PVP-co-vinyl acetate copolymers; and all of the aromatic polymers with dipole moment groups in the main-chain or side-chains, or in both the main-chain and the side-chains, and mixtures thereof.

Piezoelectric material can also comprise metals selected from the group consisting of lead, antimony, manganese, tantalum, zirconium, niobium, lanthanum, platinum, palladium, nickel, tungsten, aluminum, strontium, titanium, barium, calcium, chromium, silver, iron, silicon, copper, alloys comprising at least one of the foregoing metals, and oxides comprising at least one of the foregoing metals. Suitable metal oxides include $SiO_2$, $Al_2O_3$, $ZrO_2$, $TiO_2$, $SrTiO_3$, $PbTiO_3$, $BaTiO_3$, $FeO_3$, $Fe_3O_4$, ZnO, and mixtures thereof and Group VIA and IIB compounds, such as CdSe, CdS, GaAs, $AgCaSe_2$, ZnSe, GaP, InP, ZnS, and mixtures thereof. Preferably, the piezoelectric material is selected from the group consisting of polyvinylidene fluoride, lead zirconate titanate, and barium titanate, and mixtures thereof.

Finally, suitable magnetorheological elastomers may include an elastic polymer matrix comprising a suspension of ferromagnetic or paramagnetic particles, wherein the particles are described above. The polymer matrices include, but are not limited to, poly-alpha-olefins, natural rubber, silicone, polybutadiene, polyethylene, polyisoprene, and the like.

II. Exemplary Cleaning Mechanism and Methods of Use

In the illustrated embodiments, the mechanism 10 includes an active material element 18 coupled to a cleaning member 14 (FIG. 1-6); however, as previously mentioned, it is appreciated by those of ordinary skill in the art that other non-active material actuators may be used to drive the cleaning member 14. The member 14 contacts or is in very close proximity to the interior surface of the tube 12, and is able to move freely through a desired length of the tube 12. Upon activation, the element 18 undergoes a reversible change in a fundamental property, which in turn causes the member 14 to be displaced. The movement of cleaning member 14 dislodges recently added and/or loosely adhered deposits 16 with which the member 14 engages prior to their becoming hardened or set.

The element 18 and cleaning member 14 are cooperatively configured in all embodiments of the mechanism 10. That is to say, the element 18 is configured, such that upon activation a sufficient force to translate the member 14 is generated, given the frequency, type and quantity of deposits to be encountered, and desired stroke. A preferred embodiment is one in which the two components are connected in mechanical series, such that the activation of the element 18 causes a longitudinal displacement of the member 14 within the tube 12 (FIG. 2-5).

Figure 1:
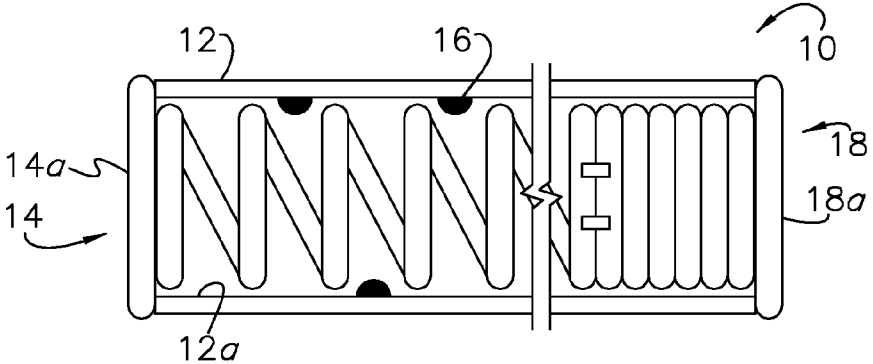
FIG. 1 is an elevation of a cleaning mechanism including an active material spring element drivenly coupled to a cleaning member also in the form of a spring, both of which presenting enlarged distal coils, in accordance with a preferred embodiment of the invention.

Returning to the preferred embodiments shown in FIGS. 1-5, there is shown variously exemplary displacement configurations of the element 18 and cleaning member 14. In FIGS. 1-1*a*, the member 14 is a steel coil spring with one end fixedly coupled to the tube 12. The element 18 is drivenly coupled to the member 14, such that through an activation cycle, displacement caused by the element 18 forces the member 14 to expand and contract, thereby dislodging deposits 16. More particularly, FIG. 1 presents an example, wherein the mechanism 10 is predominately disposed within tube 12, the cleaning member 14 presents a first spring, and the active material element 18 presents a second spring coupled to the member 14 and fixedly coupled at the opposite end of the tube 12. As shown in FIG. 1, the first and second springs 14,18 may be anchored, for example, by presenting distal coils 14*a*,18*a* having diameters greater than the inside diameter of the tube 12 adjacent the open ends of the tube 12.

In a preferred embodiment, the spring element 18 is normally in its Martensite phase and presents a spring constant, K1 (N/m), and the cleaning member 14 presents a spring constant, K2, greater than K1. When the element 18 has been activated, so as to be caused to transform to the Austenite phase, the element 18 presents a second spring constant, K3, greater than K2. As a result, it is appreciated that passive activation of the element 18 during the temperature oscillations of the process causes repetitive displacement of the coils of the spring shaped member 14. This displacement of the coils is sufficient to dislodge deposits on the surface of the tube.

In this configuration, the cleaning member spring 14 preferably presents an outside diameter generally (e.g., 97-100%) equal to the inner diameter of the tube 12 when deactivated, and substantially (93-97%) equal to the inner diameter when activated, so as to present "loose" contact with the surface. By choosing proper spring constants and the temperature threshold for the SMA spring 18, the number of strokes can be tuned to one per engine startup/shutdown or multiple throughout the engine duty cycle. It is also to be understood that the SMA spring 18 can be activated on-demand through joule heating by passing a current through the spring 18 for example even when the vehicle is parked with the powertrain cooled down to ambient temperatures.

Figure 2:
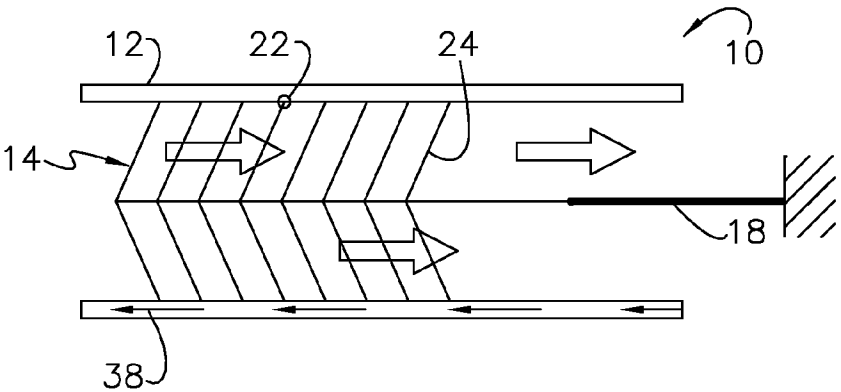
FIG. 2 is a schematic elevation of a cleaning mechanism including an active material element drivenly coupled to a scraping tool defining a plurality of sharp edges in contact with or in close proximity to the interior surface of the tube, in accordance with a preferred embodiment of the invention.
Figure 6:
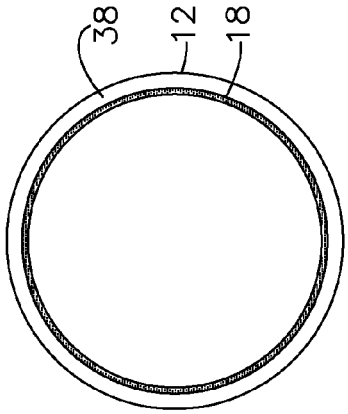
FIG. 6 is a cross section of a tube, a shape memory polymer layer interiorly superjacent to the tube, in accordance with a preferred embodiment of the invention.

It is appreciated, however, that the reduced diameter of the spring 18 when expanded may result in missed or fractionally reduced deposits (especially along the top wall of the tube 12 in horizontal applications). As such, the member 14 more preferably presents a scraping tool defining at least one, and more preferably a plurality of sharp edges 22 that directly engage or come very near (e.g., within 1 mm of) the surface 12*a* (FIG. 2). The edges 22 may be relatively fixed so that they move congruently when the tool 14 is displaced. The edges 22 may be defined by fins 24 comprised for example of bristles, hoops, etc. so as to not substantially block flow through the tube that radiate from the center of the member 14 and slope towards the direction of displacement. In this configuration, it is appreciated that the tool 14 produces greater scraping capability when caused to translate with the slope of the fins 24, and enables a more facile return when caused to translate against the slope, e.g., after the element 18 has been deactivated, and the deposits dislodged, etc. Moreover, the fins 24 are preferably sloped with, so as to reduce resistance to, the fluid flow (depicted by the arrows in FIG. 2). A singular two-way shape memory alloy wire 18 may be provided to effect a back-and-forth motion.

Figure 3:
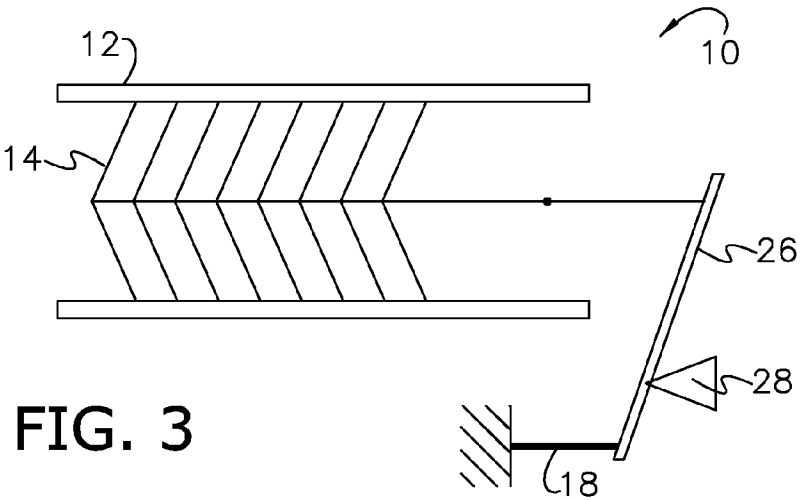
FIG. 3 is a schematic elevation of a cleaning mechanism including an active material element drivenly coupled to a cleaning member by a lever, in accordance with a preferred embodiment of the invention.

In FIG. 3, the mechanism 10 is shown having a lever 26 intermediately disposed between the element 18 and cleaning member 14. The element 18 and member 14 are preferably connected to opposite ends of the lever 26. A fulcrum 28 fixes one point of the lever 26 such that the linear displacement caused by the activation of element 18 creates a moment around that fixed point. This moment causes a longitudinal displacement of the member 14 through the desired length of tube 12. This embodiment allows for use of the mechanism 10 in different packing arrangements and provides mechanical advantage with respect to displacement or force depending upon the relative position of the fulcrum 28 and connections.

Figure 4:
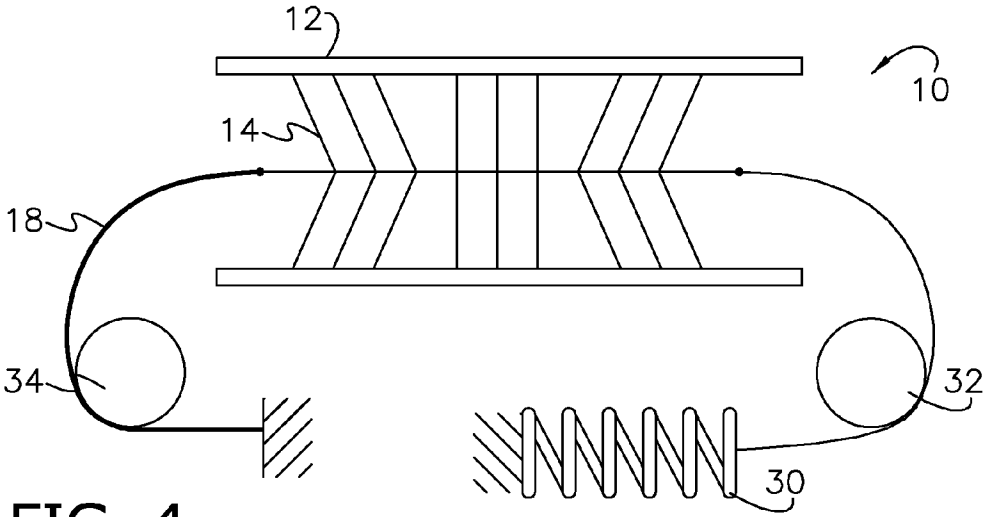
FIG. 4 is a schematic elevation of a cleaning mechanism including an active material element drivenly coupled to a scraping tool, wherein the tool and element are entrained by pulleys and the tool is drivenly coupled to an external spring configured to oppose the active material element, in accordance with a preferred embodiment of the invention.
Figure 5:
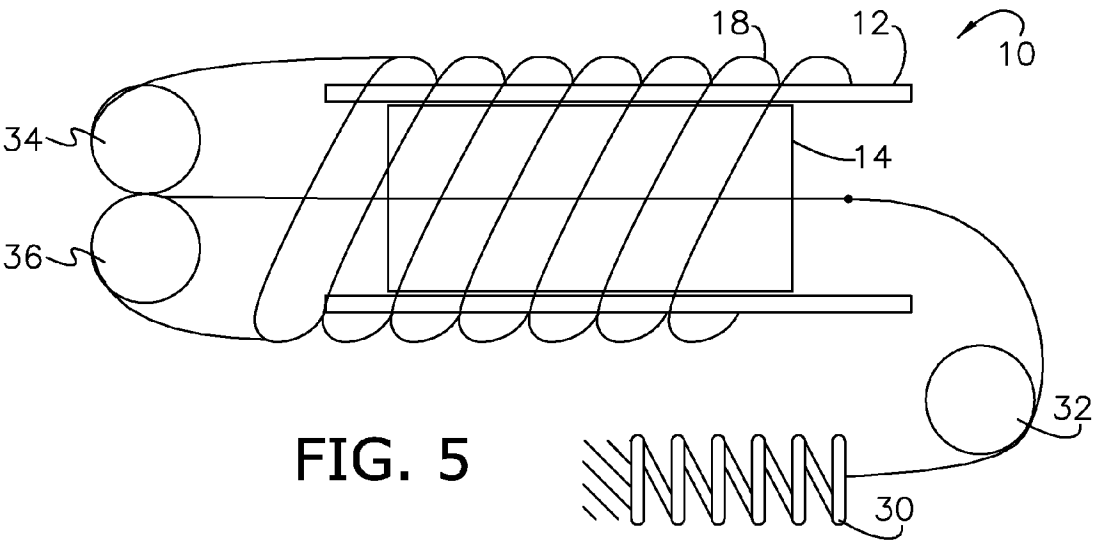
FIG. 5 is a schematic elevation of a cleaning mechanism including an external active spring element drivenly coupled to a scraping tool via first and second opposite pulleys, and further including an external return spring connected to the tool and opposing the element, in accordance with a preferred embodiment of the invention.

In FIG. 4, an external mechanical spring 30 is coupled to the cleaning tool 14 and entrained by a pulley 32, so as to provide packaging flexibility (e.g., reduce the longitudinal length of the mechanism 10). The external spring 30 offers a return mechanism that restores the position of the tool 14, after deactivation, so as to enable a one-way actuator to be utilized. Alternatively, it is appreciated that other return mechanisms, such as an antagonistic second active material element (not shown) may also be utilized. Among the many examples, the element 18 may present an externally disposed SMA wire also entrained by a second pulley 34 (FIG. 4); or as shown in FIG. 5, an external spring concentrically aligned with the tube 12.

Again, when de-activated the SMA spring 18 a spring constant, K1; the mechanical spring 30 has a spring constant of K2 greater than that of K1 and is configured to oppose the displacement caused by activation of the element 18. Upon activation, element 18 presents a spring constant, K3, greater than K2, so as to cause a displacement of the member 14. In this regard, no slack is preferably presented in the wire links. Upon deactivation, the spring constant of the element 18 reverts to K1, causing a second displacement that returns the cleaning tool 14 to the starting position. To promote linear translation, the SMA spring 18 is preferably coupled to the tool 14 through yet a third pulley 36, wherein the second and third pulleys 34,36 oppositely engage a split link that diametrically connects to the SMA spring 18 (FIG. 5).

In operation, it is appreciated that both passive signals from the environment, and on-demand/sensory based signals selectively sent from a discrete source 20 may be used to activate the element 18. For example, when adapted for use in Exhaust Gas Recirculation tubes, the active material may be selected such that activation/de-activation is triggered by starting or terminating the engine, cylinder ignition cycle, or process. That is to say, the activation signal may be produced by the heat generated from the exhaust gas passing through the tube 12. Throughout the embodiments, a coolant 38 is preferably caused to flow within the walls of the tube 12 after the process (e.g., during engine shutdown) to accelerate deactivation, and reduce bandwidth.

Alternatively, where on-demand activation is desired, an SMA wire element 18 may be remotely located and actuated by on-demand resistive heating. It is appreciated that, in this configuration, external and remote positioning enables the SMA element 18 to have a lower Austenite finish temperature. Finally, the signal may be generated as a response to sensory input. In this configuration, a suitable sensor 40 is communicatively coupled to the source 20 and operable to determine a precondition to actuation (FIG. 1*a*). For example, the sensor 40 may be configured to detect deposits 16 directly, or a milestone (e.g., the end) of the deposit producing process, and the source 20 controlled such that the element 18 is activated only when the condition is detected.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Also, as used herein, the terms "first", "second", and the like do not denote any order or importance, but rather are used to distinguish one element from another, and the terms "the", "a", and "an" do not denote a limitation of quantity, but rather denote the presence of at least one of the referenced item. All ranges directed to the same quantity of a given component or measurement is inclusive of the endpoints and independently combinable.

What is claimed is:

1. A tube cleaning mechanism adapted for removing a deposit from an interior surface of a tube, the mechanism comprising:

a cleaning member contacting or in close proximity to the surface of the tube and operable to undergo displacement within the tube upon application of a force; and an active material element, operable to undergo a reversible transformation in fundamental property when exposed to or occluded from an activation signal, so as to be activated and deactivated respectively, and drivenly coupled to the member, such that the transformation generates the force;

the member and element being cooperatively configured, such that displacing the member within the tube causes the member to remove the deposit;

the element being formed of an active material selected from the group consisting essentially of shape memory alloys, bimorphic piezoelectrics, electroactive polymers, ferromagnetic shape memory alloys, and magnetorheological elastomers.

2. The mechanism as claimed in claim 1, wherein the element is affixed in mechanical series to the member, such that the force causes longitudinal displacement of the member.

3. The mechanism as claimed in claim 1, wherein the cleaning member is a mechanical spring having one end fixedly coupled to the tube, and presenting a first spring constant.

4. The mechanism as claimed in claim 3, wherein the active material element presents a second spring drivenly coupled to the mechanical spring and presenting a second spring constant less than the first, when de-activated, and a third spring constant greater than the first, when activated.

5. The mechanism as claimed in claim 1, wherein the cleaning member is a scraping tool defining a plurality of relatively fixed edges, so as to present congruent motion.

6. The mechanism as claimed in claim 5, wherein the edges are defined by a plurality of longitudinally sloped fins, and the fins are radially sloped towards the displacement, and with fluid flow.

7. The mechanism as claimed in claim 5, further comprising:

an external spring connected in mechanical series with the scraping tool, and configured to produce a countering force operable to reverse the displacement of the tool, when the element is deactivated.

8. The mechanism as claimed in claim 7, further comprising:

at least one pulley intermediately coupled to the external spring and tool and configured to redirect the countering force.

9. A tube cleaning mechanism adapted for removing a deposit from an interior surface of a tube, the mechanism comprising:

a cleaning member contacting or in close proximity to the surface of the tube and operable to undergo displacement within the tube upon application of a force;

an active material element, operable to undergo a reversible transformation in fundamental property when exposed to or occluded from an activation signal, so as to be activated and deactivated respectively, and drivenly coupled to the member, such that the transformation generates the force;

a lever coupling the element and member; and a fulcrum associated with the lever, such that the force creates a moment;

the element, lever, fulcrum, and member being cooperatively configured, such that the moment causes the displacement, and the member and element being cooperatively configured, such that the displacement of the member within the tube causes the member to remove the deposit.

10. A tube cleaning mechanism adapted for removing a deposit from an interior surface of a tube, the mechanism comprising:

a cleaning member contacting or in close proximity to the surface of the tube and operable to undergo displacement within the tube upon application of a force, wherein the cleaning member is a scraping tool defining a plurality of relatively fixed edges, so as to present congruent motion;

an active material element, operable to undergo a reversible transformation in fundamental property when exposed to or occluded from an activation signal, so as to be activated and deactivated respectively, and drivenly coupled to the scraping tool, such that the transformation generates the force;

an external spring connected in mechanical series with the scraping tool, and configured to produce a countering force operable to reverse the displacement of the scraping tool when the element is deactivated, the external spring having a first spring constant; and at least one pulley intermediately coupled to the external spring and the scraping tool and configured to redirect the countering force;

wherein the active material element presents a second spring having a second spring constant less than the first spring constant when de-activated, and a third spring constant greater than the first spring constant when activated.

11. The mechanism as claimed in claim 10, wherein the second spring is externally disposed relative to and concentric with the tube, and interconnected to the tool through second and third opposite pulleys.

12. A method of removing a surface deposit from an interior surface of an Exhaust Gas Recirculation cooling tube, the method comprising:

a. securing an active material element relative to the tube, the element being drivenly coupled to a cleaning member contacting or in close proximity to the surface of the tube, the element being operable to undergo a reversible transformation in fundamental property when exposed to or occluded from an activation signal, so as to be activated and deactivated respectively such that the transformation generates a force, and the element being formed of an active material selected from the group consisting of shape memory alloys, bimorphic piezoelectrics, electroactive polymers, ferromagnetic shape memory alloys, and magnetorheological elastomers;

b. determining a predetermined condition;

c. activating the element, when the condition is determined, thereby generating the force and displacing the cleaning member within the tube; and d. causing the surface deposit to be removed from the surface as a result of activating the element.

13. The method as claimed in claim 12, wherein the tube conveys a heated fluid, the element is thermally activated, and steps b) and c) further comprise the steps of passively achieving a predetermined fluid temperature, and thermally coupling the element and fluid, so as to activate the element when the fluid temperature is achieved.

14. The method as claimed in claim 12, wherein at least one sensor is communicatively couple to any of the tube or element, and steps b) and c) further include the steps of detecting the condition with the sensor, and producing the activation signal when the condition is detected.

15. The method as claimed in claim 12, wherein the deposit is autonomously produced by an external process communicatively couple to the tube, and the condition is the end of the process.

16. The method as claimed in claim 12, wherein steps b) and c) further include the steps of receiving an on-demand input, and producing the activation signal when the input has been received.

* * * * *